United States Patent [19]

Müller

[11] Patent Number: 4,645,101

[45] Date of Patent: Feb. 24, 1987

[54] DEVICE FOR MOUNTING ARTICLES OF CLOTHING IN AN IRONING APPARATUS

[75] Inventor: Kurt Müller, Rottweil, Fed. Rep. of Germany

[73] Assignee: Sanetta Textilwerk Gebruder Ammann, Messstetten, Fed. Rep. of Germany

[21] Appl. No.: 817,403

[22] Filed: Jan. 9, 1986

[30] Foreign Application Priority Data

Jul. 29, 1985 [DE] Fed. Rep. of Germany ..... 3515355

[51] Int. Cl.[4] ..... D06F 59/02; D06F 71/16; D06F 93/00

[52] U.S. Cl. ..... 223/66; 38/1 B; 38/7; 223/69

[58] Field of Search ..... 223/24, 25, 26, 51, 223/66, 69, 74, 77; 38/1 B, 7, 8, 1

[56] References Cited

U.S. PATENT DOCUMENTS 703,442 7/1902 Mund ..... 223/25

1,065,856 6/1913 Wickersheim ..... 223/25

3,811,607 5/1974 Glaze ..... 223/77

*Primary Examiner*—Louis K. Rimrodt

*Attorney, Agent, or Firm*—Dick and Harris

[57] ABSTRACT

A device for mounting articles of clothing for controlling purposes or for smoothing in an ironing apparatus, comprising a mounting frame and a holding section which holds the latter and sits on a revolving conveyor, is described.

To eliminate the making available of a plurality of mounting frames adapted to the various sizes of articles of clothing of a design range, and, consequently, the time-consuming exchanging of mounting frames on the holding sections of the revolving conveyor, it is proposed that the mounting frame be constituted by two component frames arranged alongside each other in the direction of advance, which are adjustable relative to each other by an adjustment device provided on the holding section for alteration of their spacing.

11 Claims, 4 Drawing Figures

DEVICE FOR MOUNTING ARTICLES OF CLOTHING IN AN IRONING APPARATUS

Figure 1:
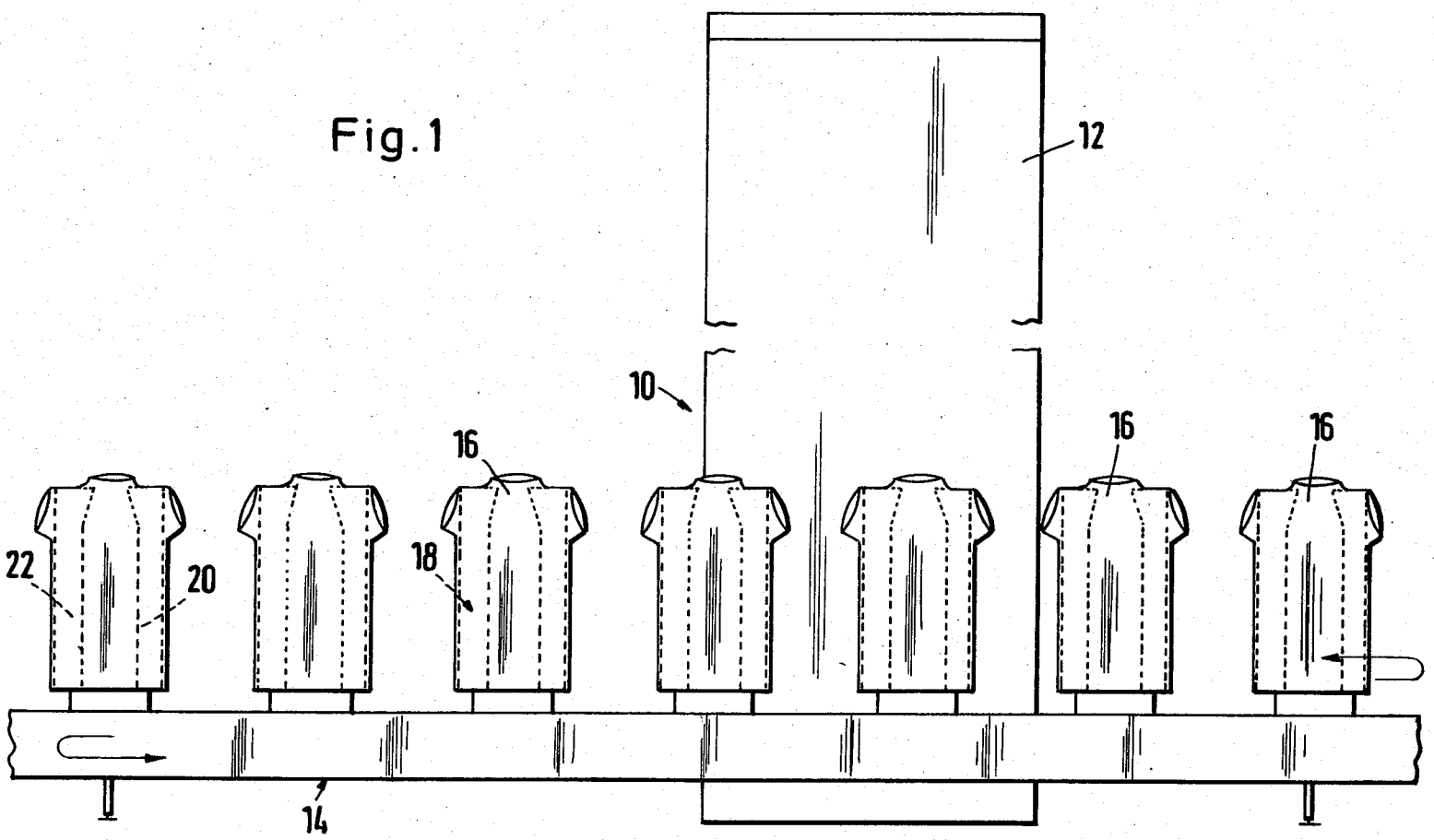

The invention relates to a device for mounting articles of clothing for controlling purposes or for smoothing in an ironing apparatus, with a mounting frame and a holding section which holds the latter and sits on a revolving conveyor.

In the clothing industry, the smoothing of articles of clothing is carried out mechanically. The articles of clothing are each mounted individually on a mounting frame of a mounting device which then travels through an ironing apparatus in which the article of clothing is smoothed by being subjected to steam, heat and pressure.

Rational, mechanical ironing of articles of clothing was enabled by first mounting in succession a plurality of mounting frames in an upright exchangeable manner on a revolving conveyor which travels through the ironing apparatus. With a change in size of articles of clothing belonging to one range or a change of design, it was then necessary to dismantle all of the mounting frames from the revolving conveyor and exchange them for other suitable mounting frames. This involved considerable work expenditure and long idle times of the ironing apparatus had to be tolerated.

These disadvantages were substantially reduced by arranging on the revolving conveyor for each mounting frame a holding section to which the mounting frames are attachable simply by insertion, thereby making them relatively quick to exchange. There is, however, the disadvantage that mounting frames must be available for all sizes of articles of clothing of one design range, and a change in size then also necessitates a change-over to the receiving frames with the correct size.

The object underlying the invention is, therefore, to improve a device of the kind described at the outset, with a mounting frame and a holding section, in such a way as to eliminate the necessity of availability of a plurality of mounting frames adapted to the various sizes of articles of clothing of a design range, and, consequently, the time-consuming exchanging of mounting frames on the holding sections of the revolving conveyor. The device should also enable automatic conversion of the mounting frames to other sizes of articles of clothing.

This object is attained in accordance with the invention in that the mounting frame is formed by two component frames arranged alongside each other in the direction of advance, and in that the mutual spacing between the two component frames is alterable by an adjustment device provided on the holding section.

The division of the mounting frame into two component frames enables their mutual spacing to be maintained in conformance with the size of the articles of clothing to be ironed, with merely one or both of the component frames being jointly appropriately adjustable by the adjustment device provided for this purpose on the holding section.

The device according to the invention may equally well be used for controlling finished articles of clothing, by the latter being placed onto mounting frames and then made to pass a control point where they are visually checked for possible faults in the manufacture.

In an advantageous construction of the adjustment device, one holding member is provided for each component frame, and the holding members are jointly adjustable in opposite directions by a setting member. The setting member may, for example, be a threaded spindle which, with threaded sections of opposed pitch, engages one of the holding members, respectively.

In a preferred embodiment of the adjustment device, the holding members are each held on one of two toothed racks, horizontally guided in spaced superimposed relationship, which are adjustable in opposite directions by a gear wheel arranged between them.

An essential advantage of the invention is that, as already indicated above, it advantageously enables automatic conversion of the mounting frames to various sizes of articles of clothing without prior manual alteration of the spacing of the component frames from each other. The alteration of the mutual spacing between the two component frames with a change in size of the articles of clothing may, therefore, be performed automatically in accordance with a work programme. This may be advantageously effected by a setting device arranged stationarily on the advance path by means of which the setting member of the adjustment device is automatically appropriately adjustable.

A setting device of particularly simple construction comprises two rigidly connected legs, adjustable in height, which open in the direction opposite to the direction of advance and extend, with their leg end portions extending in the direction of advance, parallel to each other and to the plane of advance. The adjustment device comprises as setting member a crank connected for rotation with the gear wheel which, with its free crank arm enters between the legs opening in a jaw-type manner, and finally runs along one of the legs, thereby being more or less swivelled in dependence upon the height position at which the setting device is set.

In a preferred embodiment of the invention, the adjustment device is arranged between two plates of the holding section standing upright on the revolving conveyor, and the component frames are removably held with one foot each on one of the holding members of the adjustment device.

Figure 2:
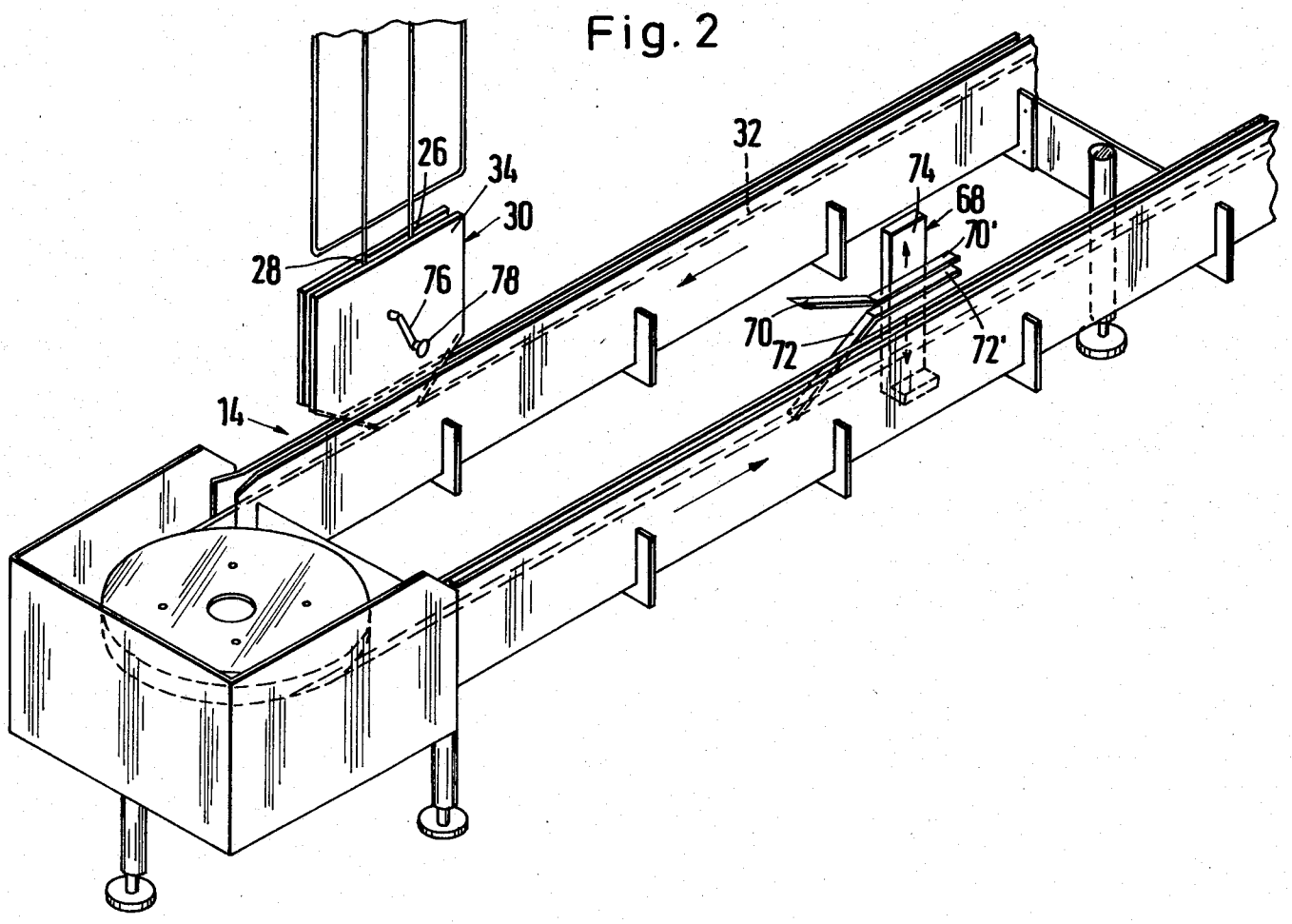
Figure 3:
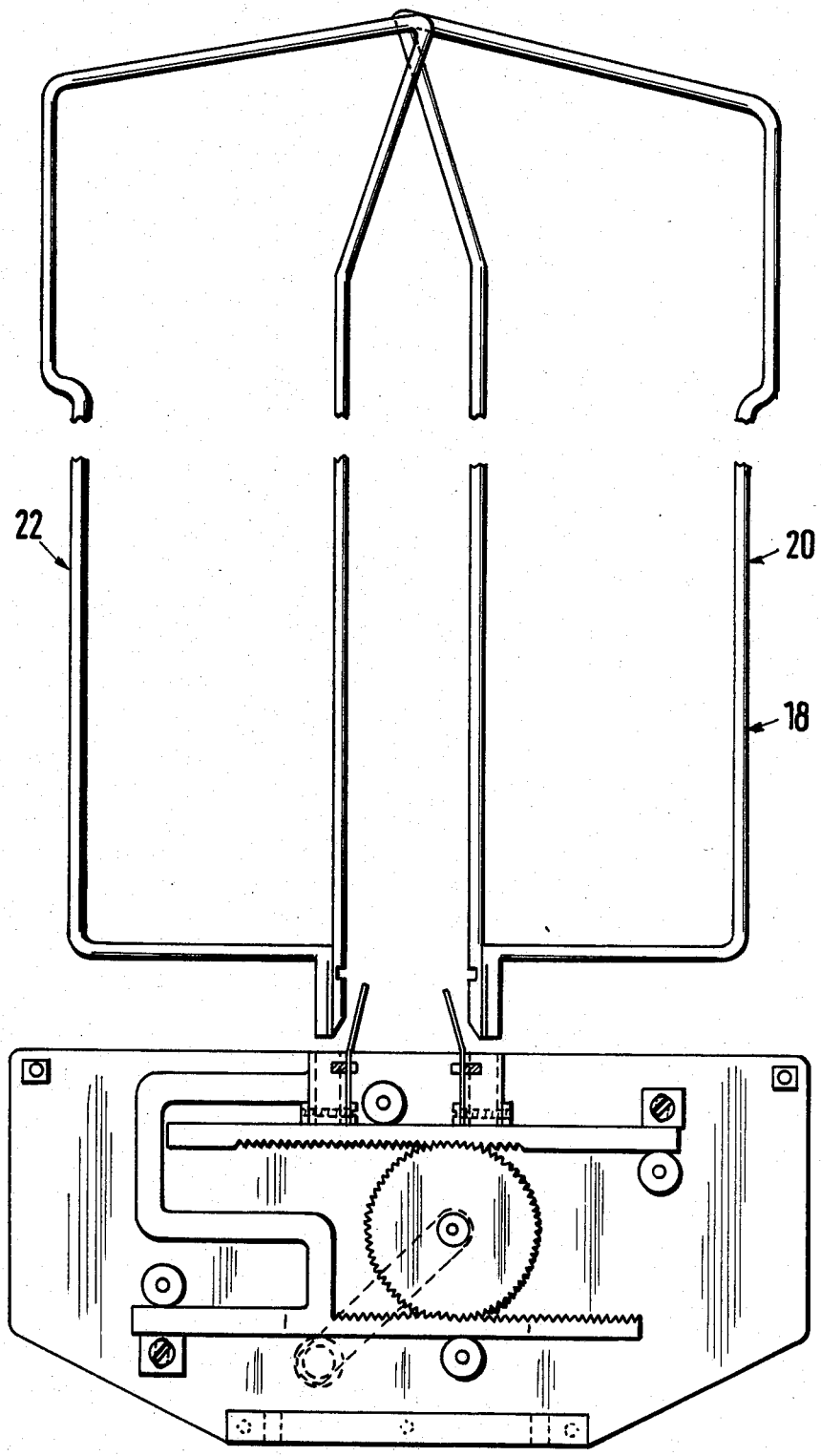
Figure 4:
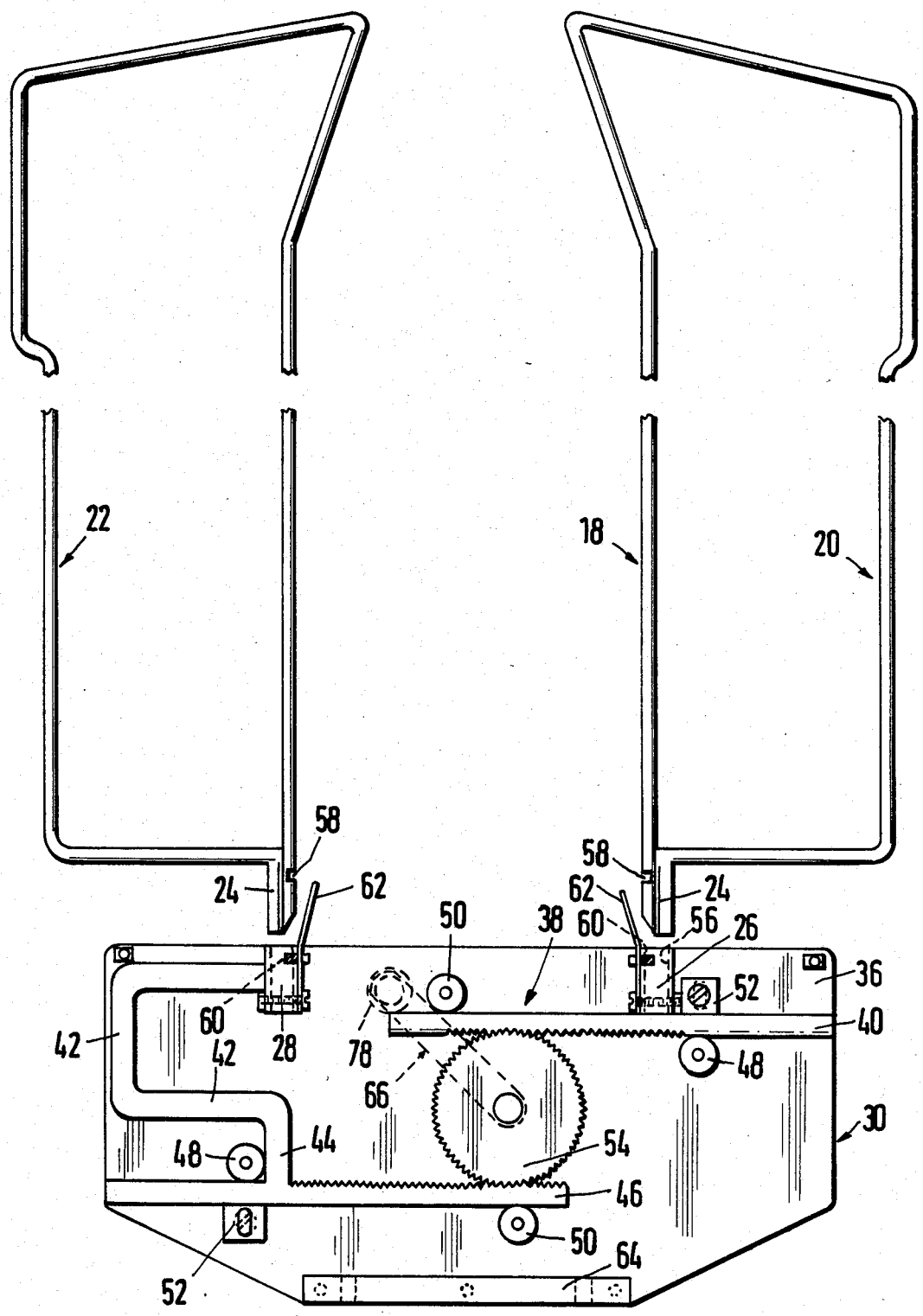

Further features and details of the invention are explained in the following description of an embodiment of a device according to the invention, as illustrated in the drawings. The drawings show schematically:

FIG. 1 a side view of an ironing apparatus whose horizontally revolving conveyor is provided with a plurality of mounting devices for articles of clothing, FIG. 2 a perspective illustration of the left end section of the revolving conveyor, viewed at an incline from above, FIG. 3 a longitudinal section taken through the mounting device, with both component frames shown in the state in which they are removed from the holding members of the adjustment device of the holding section of this device, FIG. 4 an illustration similar to FIG. 3, with the component frames illustrated at a larger mutual spacing from each other.

FIG. 1 shows an ironing apparatus 10, known per se, for mechanically steaming and smoothing shirt-type articles of clothing such as T-shirts or the like. It comprises a processing line 12 containing a steam chamber, a smoothing device and a recirculated air chamber, through which the articles of clothing to be smoothed travel in succession. This is effected with the aid of a horizontally guided revolving conveyor 14 comprising a plurality of devices, designated in their entirety by 18 in FIGS. 1, 3 and 4, for mounting one such article of clothing 16 each in a taut manner.

These devices 18 sit—viewed in the direction of advance of the revolving conveyor—equidistantly behind one another on its conveyor member, constituted, for example, by a chain, with each article of clothing having to be manually placed onto a mounting frame of these devices requiring adaptation to the size of the articles of clothing to be smoothed such that, in the mounted state, these are held tautly, i.e., substantially crease- and wrinkle-free.

As FIGS. 3 and 4 show, the mounting frame of the devices 18 consists of two component frames 20 and 22 arranged alongside each other in the direction of advance, which are preferably bent from round stock consisting of stainless steel and constructed in symmetrical relationship to each other. Each component frame is provided with an insert foot 24 with which it is releasably inserted into a holding member 26 and 28, respectively, of a holding section 30 detachably secured to the endless conveyor member.

It is advantageous for the holding section 30 to be constructed in the form of a narrow elongate cassette comprising two parallel spaced plates 34 and 36 arranged upright on the conveyor member 32 of the revolving conveyor 14. The holding members 26, 28 for upright insertion of the component frames 20, 22 are provided between the plates on the upper side of the holding section 30. These two holding members constitute part of an adjustment device designated in its entirety by 38, which is arranged between the plates 34, 36 and with whose aid the mutual spacing between the two component frames 20, 22 is alterable, preferably in an infinitely variable manner (see FIGS. 3 and 4) in order to adjust the mounting frame to the size of the respective articles of clothing 16 to be smoothed. To this end, the holding member 26 is arranged on an upper toothed rack 40 horizontally guided between the two plates 34, 36, and the holding member 28 is held on a T-shaped holder 42, whose lower leg 42′ is attached with a downwardly bent leg end piece 44 to a lower toothed rack 46, which is likewise mounted for horizontal displacement between the two plates 34, 36. Provided for this purpose are two guide rollers 48, 50 which are arranged in spaced relationship along the toothed racks 40, 46 and abut an upper and a lower longitudinal side of the toothed racks, respectively, and also a height-adjusting bearing block 52 arranged opposite the one guide roller 48 for infinite height adjustability and detention, thereby enabling alignment of the two toothed racks 40, 46 in horizontal planes parallel to each other.

In engagement with both toothed racks 40, 46 is a gear wheel 54 which is mounted for rotation between these in the holding section 30, and whose rotation causes the two toothed racks 40, 46 to be displaced in opposite longitudinal directions. In analogy with the guide rollers 48, the gear wheel 54 likewise assumes a guiding function for the two toothed racks 40, 46.

As FIG. 3 shows, the T-shaped holder 42 carrying the holding member 28 offers the advantage that the two holding members 26, 28 may be brought very close together, thereby making the mutual spacing between the two component frames 20, 22 relatively small, by the upper toothed rack 40 being able to sink with its free end into the T-shaped holder 42.

This construction enables reduction of the length of the toothed rack to a minimum.

The insert foot 24 of the two component frames 20, 22 exhibit a non-circular cross-sectional shape. Associated with it is an insert opening 56 fitted in the holding members 26, 28 so that the component frames 20, 22 are held in a rotation-preventive manner when positioned on the holding section 30. The insert feet are provided with a notch recess 58 with an associated notch 60 in each of the holding members 26 and 28, which is movable into a disengagement position by a spring lever 62 to release the component frames 20, 22.

Located on the underside of the holding section 30 between the two plates 34, 36 is a bottom piece 64 which is attachable in a suitable manner, for example, by screwing, to the conveyor member 32.

As FIG. 4 shows, the gear wheel 54 is rotatable by a setting member in the form of a crank 66 which, when the cassette-shaped holding section 30 is mounted on the conveyor member 32, is located on the inside of it. With the aid of this crank it is possible to adjust the two component frames 20, 22 manually to a desired mutual spacing, with such frictional conditions being settable by the bearing blocks 52 at the toothed racks 40, 46 that once the two component frames are set in relation to each other, this is maintained even if the article of clothing is mounted in a relatively taut manner. A scale enabling the component frames 20, 22 to be quickly set at the spacing required for a certain size of articles on clothing to be worked on may be provided on the upper side of the cassette-shaped holding section 30.

With the described construction of the adjustment device 38 it is, furthermore, possible to eliminate manual setting of the spacing between the component frames 20, 22 and to do this fully automatically. This is achieved in a simple way with a setting device designated in FIG. 2 in its entirety by 68, with whose aid the crank 66 on the holding section 30 of the devices 18 may be appropriately swiveled. This setting device 68 is arranged on the inside of one strand of the revolving conveyor 14 and comprises a setting curve formed by two flat legs 70, 72 opening in the direction opposite to the direction of advance indicated by an arrow, with their adjoining leg portions 70′, 72′ extending parallel to each other and to the plane of advance. The legs 70, 72 are arranged in a height-adjustable manner on a stationary carrier 74, with the height adjustment being made automatically, for example, by a motor-driven threaded spindle, which for reasons of simplicity is not illustrated. The spacing between the remote ends of the two legs 70, 72 is chosen so large that in the case of both the lowest and the highest settings of the curve device constituted by the two legs 70, 72, a curve roller 78 mounted on the free crank leg 76 of the crank 66 makes contact with the internal flat side of one of the two legs 70, 72, with the precondition of such an arrangement of the setting device 68 being that both legs 70, 72 be located in the vertical plane of motion of the curve roller 78. If the latter contacts one of the legs 70, 72, this causes the crank to be swivelled, with its curve roller 78 finally entering between the two leg end portions 70′, 72′ and maintaining its position, which then corresponds to a desired setting of a lateral spacing between the two component frames 20, 22.

If in the case of a change in size of similar articles of clothing or a change of design, the mounting frames of the devices 18 require corresponding adjustment, this may be done fully automatically after prior actuation of the setting device 68 in order to set it at a certain height position.

It is clear that the adjustment device 38 of the holding sections 30 may also be constructed differently from the embodiment explained. It must only be capable of adjusting the two holding members 26, 28 accommodating the component frames 20, 22 in the explained manner relative to one another. Furthermore, instead of a cassette-shaped design, the holding section 30 may also have another suitable shape, i.e., adapted to the revolving conveyor of the ironing apparatuses well-established on the market. This is particularly applicable to the manner in which the holding section 30 is attachable to the conveyor member 32 of a revolving conveyor.

Finally, a construction wherein the adjustment device is provided separately from the holding section and which directly engages it for adjustment of the component frames, is also regarded as covered by the disclosure. In this case, it is merely necessary for the component frames to be adjustably arranged on the holding section, while the adjustment device may be stationarily provided on the revolving conveyor and engage one or both of the component frames.

Instead of the described construction, the adjustment device may also be arranged horizontally.

What is claimed is:

1. An apparatus for mounting articles of clothing for controlling purposes or for smoothing in an ironing apparatus comprising;

one or more substantially rigid mounting frames for mounting said articles of clothing;

a holding section operatively associated with each of said mounting frames;

conveyor means operably associated with said holding section so as to carry said holding sections along as said conveyor means advances;

said mounting frames being comprised of two or more integral component frames arranged alongside each other;

one or more of said component frames further being separable from the remaining component frames within a range of possible separation; and an adjustment device operably associated with said holding section so as to enable alteration of said mutual separation between said component frames in a virtually infinitely vaariable manner without said range of possible separation.

2. The apparatus as recited in claim 1 wherein said component frames are aligned substantially parallel to the direction of advance of said conveyor means.

3. The apparatus as recited in claim 1 wherein said mounting frames are carried along by said conveyor means in a substantially upright fashion as said conveyor means advances.

4. The apparatus as recited in claim 1 wherein each of said mounting frames comprise two substantially rigid integral component frames.

5. The apparatus as recited in claim 1 wherein said adjustment device further comprises:

at least one holding member operably associated with each of said component frames; and a setting member operably associated with said holding members so as to move said holding members in opposite relative directions.

6. The apparatus as recited in claim 5 wherein said adjustment device further includes said component frames being selectively detachable from said holding members.

7. The apparatus as recited in claim 5 wherein said setting member further comprises:

a gear wheel member;

toothed racks operably attached to each of said holding members;

said toothed racks being further substantially horizontally guided in a spaced superimposed relationship;

said gear wheel being operatively interposed between said toothed racks; and a crank operably associated with said gear wheel so that rotation of said crank results in movement of said holding members in opposite respective directions.

8. The apparatus as recited in claim 7 wherein said holding section further comprises:

two or more substantially parallel, vertical plates;

said setting member being substantially arranged between said plates;

said crank protruding from said plates; and said plates being arranged substantially upright on said conveyor means.

9. The apparatus as recited in claim 7 wherein said setting member further comprises separation adjustment means operatively positioned along side the path of advance of said conveyor means so as to engage said adjustment device and automatically adjust said mutual separation between said component frames.

10. The apparatus as recited in claim 9 wherein said separation adjustment means further comprises:

two or more legs;

said legs being securely positioned in a substantially parallel arrangement so as to have an open front end and an open rear end;

said legs being configured so as to have a substantially converging portion proximate said front end and extending towards said rear end;

said legs being further configured so as to have a substantially parallel portion extending from said converging portion to said rear end;

said substantially parallel portion extending in said direction of advance of said conveyor means;

said converging portion of said legs opening in a direction opposite to said of advance; and said open end capable of accommodating and guiding said crank into said converging portion and through said substantially parallel portion of said legs, as said holding sections advance along said conveyor means.

11. The apparatus as recited in claim 10 wherein said separation adjustment means further comprises height adjustment means for selectively altering the height of said legs.

* * * * *

UNITED STATES PATENT AND TRADEMARK OFFICE

CERTIFICATE OF CORRECTION

PATENT NO. : 4,645,101

DATED : February 24, 1987

INVENTOR(S) : Kurt Muller

It is certified that error appears in the above-identified patent and that said Letters Patent is hereby corrected as shown below:

| | |
|---|---|
| Column 5, line 46 | "vaariable" should be instead -- variable -- |
| Column 6, line 51 | Insert between "said" and "of" -- direction -- |

Signed and Sealed this

Eleventh Day of August, 1987

*Attest:*

DONALD J. QUIGG

*Attesting Officer*

*Commissioner of Patents and Trademarks*